US005961114A

United States Patent [19]

Barker et al.

[11] Patent Number: 5,961,114

[45] Date of Patent: Oct. 5, 1999

[54] MAILPIECE STACKING STRUCTURE

[75] Inventors: Donald E. Barker, Sandy Hook; James G. Gleason, Stratford; Robert J. Hebert, Southbury, all of Conn.

[73] Assignee: Pitney Bowes Inc., Stamford, Conn.

[21] Appl. No.: 08/976,221

[22] Filed: Nov. 21, 1997

[51] Int. Cl.[6] ..... B65H 29/00

[52] U.S. Cl. ..... 271/184; 271/198; 271/216; 271/223; 271/224

[58] Field of Search ..... 414/789.7, 900; 271/223, 224, 216, 198, 184, 150, 151

[56] References Cited

U.S. PATENT DOCUMENTS

| | | | |
|---|---|---|---|
| 3,420,387 | 1/1969 | Baum | 414/900 |
| 3,935,429 | 1/1976 | Branecky et al. | 235/61.11 |
| 3,945,635 | 3/1976 | Marin | 271/202 |
| 3,977,537 | 8/1976 | Buccicone | 414/900 |
| 4,484,736 | 11/1984 | Osburg | 271/220 |
| 4,509,703 | 4/1985 | Grunder | 271/216 |
| 4,767,115 | 8/1988 | Garthe | 271/223 |
| 4,787,621 | 11/1988 | Sattler | 414/900 |
| 4,826,421 | 5/1989 | Asano et al. | 271/223 |
| 4,927,133 | 5/1990 | Evans | 271/225 |
| 5,060,930 | 10/1991 | Pilling | 271/268 |
| 5,087,026 | 2/1992 | Wyer | 271/188 |
| 5,180,157 | 1/1993 | Helit | 271/256 |
| 5,364,090 | 11/1994 | Hollis | 271/216 |
| 5,484,255 | 1/1996 | Kowell | 414/900 |
| 5,508,818 | 4/1996 | Hamma | 358/403 |
| 5,553,843 | 9/1996 | Schenk | 271/226 |
| 5,615,995 | 4/1997 | Nobile | 414/798.2 |

*Primary Examiner*—Christopher P. Ellis
*Assistant Examiner*—Douglas Hess
*Attorney, Agent, or Firm*—Steven J. Shapiro; Melvin J. Scolnick

[57] ABSTRACT

An apparatus for stacking mailpieces received from a mail processing machine includes a deck; a sloped wall extending from the deck; a plurality of continuous belts each extending along the deck in a first direction and positioned at substantially equal intervals along a second direction of the deck, each of the plurality of continuous belts having a top surface which extends above the deck and which contacts the mailpieces received from the mail processing machine; structure for driving the plurality of belts in the first direction to move the received mailpieces along the sloped wall in a shingled configuration; a registration wall disposed on the deck to define a landing area on the deck for the received mailpieces, the registration wall being mounted for slideable movement along the deck in the second direction to change a size of the landing area to accommodate the receiving of different sized mailpieces from the mail processing machine; and structure, connected to the registration wall and the plurality of continuous belts, for automatically moving at least some of the plurality of continuous belts along the second direction in response to movement of the registration wall along the second direction, wherein at times when the registration wall is moved along the second direction the intervals at which the plurality of continuous belts are positioned along the second direction change in size but remain substantially equal to each other.

7 Claims, 4 Drawing Sheets

MAILPIECE STACKING STRUCTURE

BACKGROUND OF THE INVENTION

The present invention relates generally to the field of mailpiece stacking machines, and more particularly to mailpiece stacking machines intended for use with small or medium volume mail handling machines.

Mailpiece stacking machines are well known and have been used quite successfully in conjunction with mailing machines or other mailpiece processing machines such as mail counting machines, mail stamp cancellation machines, inserting machines, and envelope printing machines. Typically, these stacking machines include an elongate frame which defines a feed path along which mailpieces are fed toward a stacking location. The feed path is normally located at a lower level than the output location of the mail processing machine so that mailpieces ejected by the mail processing machine fall onto driven elongate conveyor belts, mounted on the elongate frame, which carry the mailpieces along the feed path to the stacking location. At the stacking location there is an upwardly angled wall which forms a ramp against which the mailpieces are stacked by the conveyor belt. Additionally, a pressure wheel is often pivotally mounted over the conveyor belts at a point along the feed path such that after the mailpieces have fallen onto the conveyor belt they pass under the pressure wheel which ensures that the mailpieces maintain effective feeding contact with the conveyor belt.

In conventional mailing machines, the mailpieces are ejected from the mail processing machine at a greater linear speed than that at which the conveyor belt of the stacking machine is moving so that the mailpieces fall onto the conveyor belt in a shingled relationship along their length and are carried in that relationship to the ramp. The stacking of the mailpieces continues in this manner until the stack reaches a point where it extends from the ramp to the pressure wheel. At that point in time, the accumulated stack must be removed from the stacking machine.

Stacking machines of this nature are typically in the order of 28 to 44 inches in length and can accumulate a stack of mail that would reach a height of about 16 inches if stood on end. However, these known in-line stacking machines significantly extend the elongate footprint of the mailing machine they operate in conjunction with such that they are normally used only by high volume mailers with mailing machines that process and eject from 5,000 to 15,000 pieces of mail per hour. That is, small volume mailers often cannot justify the cost associated with conventional in-line stackers and do not have the physical space required for them such that they often use a gravity stacker. The gravity stacker is little more than a container disposed below the level of the mail processing machine which collects the mailpieces as they are ejected from the mail processing machine. A serious limitation of this machine is that modern mail processing equipment is being designed with very low profiles such that the capacity of the gravity stacker is very limited if mounted on the same frame as the mail processing machine.

In addition to the above, conventional in-line stackers stack mailpieces along their length such that an operator cannot easily see the address or indicia on each mailpiece as it is conveyed away from the mailing machine. Accordingly, mailpieces with either an improper address or improper postage are not easily detected. Furthermore, since conventional in-line stackers stack the mailpieces lengthwise, significant bending of the mailpieces in the stack can occur, particularly for thick mailpieces. The bending of the mailpieces often results in sealed flaps becoming unsealed due to the bending stress. Finally, with lengthwise stacking the volume of mailpieces that can be stacked per unit length is significantly less than if the mailpieces were stacked along their shorter width.

In view of the above, the instant inventors developed a stacker that receives mailpieces from the mail processing machine and carries the mailpieces away in a direction orthogonal to the direction they are ejected from the mail processing machine. Thus, the mailpieces are stacked along their width. However, the inventors encountered a problem with this type of stacker which is related to the size of the mailpieces being processed by the mailing machine. That is, low to medium volume mail processing machines typically process a batch of mailpieces of the same size. However, the size of the mailpieces between different batches can vary. Thus, in the stacker developed by the inventors if the stacker is set up to accommodate large size mailpieces individual mailpieces of a smaller size can get caught under the conveyor belts used to stack the mailpieces or may land on the conveyor belts in a skewed configuration and subsequently be conveyed into the stack in the skewed position. Thus, what is needed is an adjustable stacking machine which can be easily reconfigured to accommodate different size mailpieces and overcome the problems discussed immediately above.

SUMMARY OF THE INVENTION

It is an object of the invention to provide a stacking machine which overcomes the disadvantages of the prior art discussed above.

The above object is met by an apparatus for stacking mailpieces received from a mail processing machine, the apparatus including a deck; a sloped wall extending from the deck; a plurality of continuous belts each extending along the deck in a first direction and positioned at substantially equal intervals along a second direction of the deck, each of the plurality of continuous belts having a top surface which extends above the deck and which contacts the mailpieces received from the mail processing machine; structure for driving the plurality of belts in the first direction to move the received mailpieces along the sloped wall in a shingled configuration; a registration wall disposed on the deck to define a landing area on the deck for the received mailpieces, the registration wall being mounted for slideable movement along the deck in the second direction to change a size of the landing area to accommodate the receiving of different sized mailpieces from the mail processing machine; and structure, connected to the registration wall and the plurality of continuous belts, for automatically moving at least some of the plurality of continuous belts along the second direction in response to movement of the registration wall along the second direction, wherein at times when the registration wall is moved along the second direction the intervals at which the plurality of continuous belts are positioned along the second direction change in size but remain substantially equal to each other.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
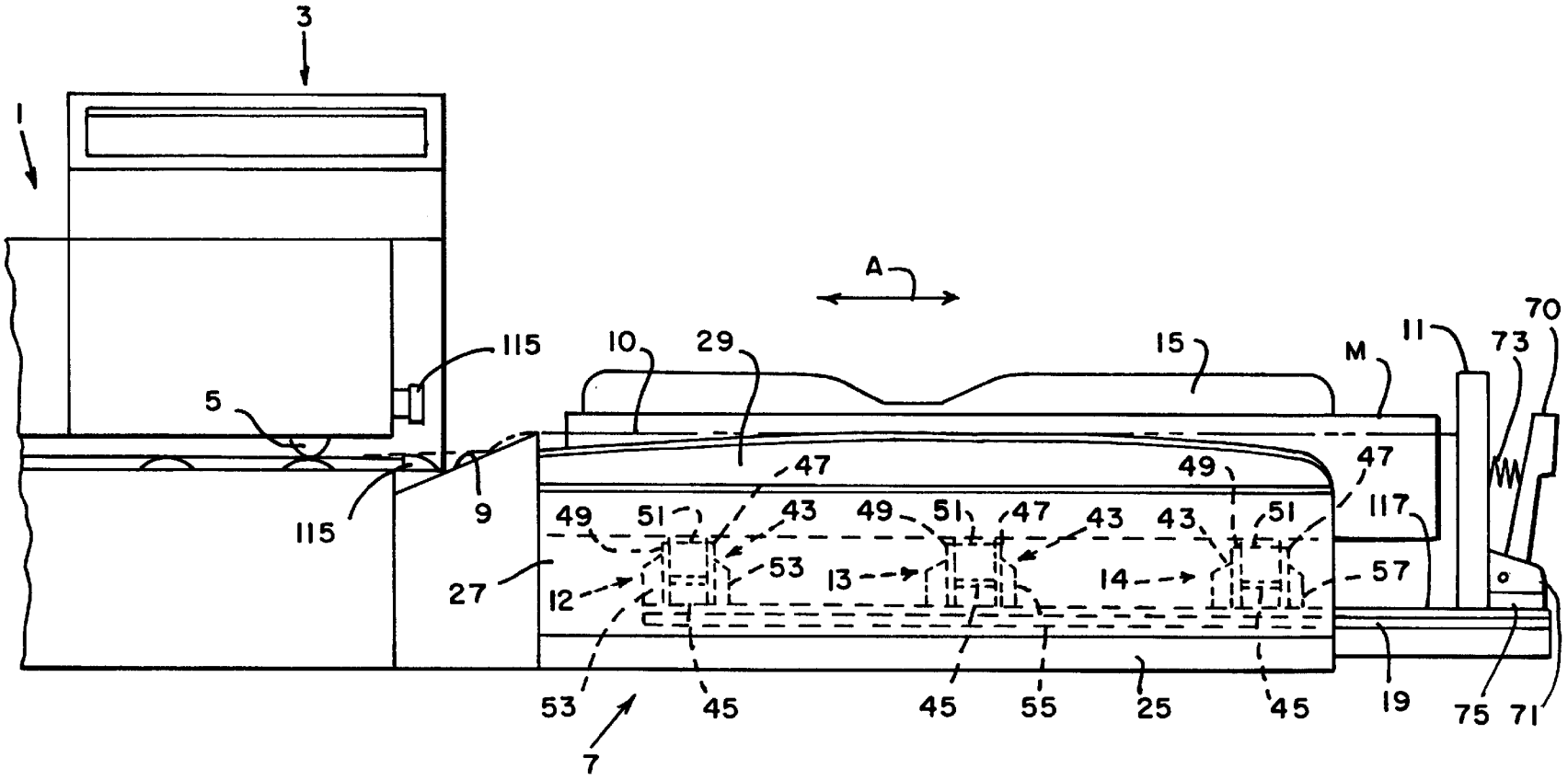
FIG. 1 is a front elevational view of the inventive stacking machine in combination with a mail processing machine.
Figure 2:
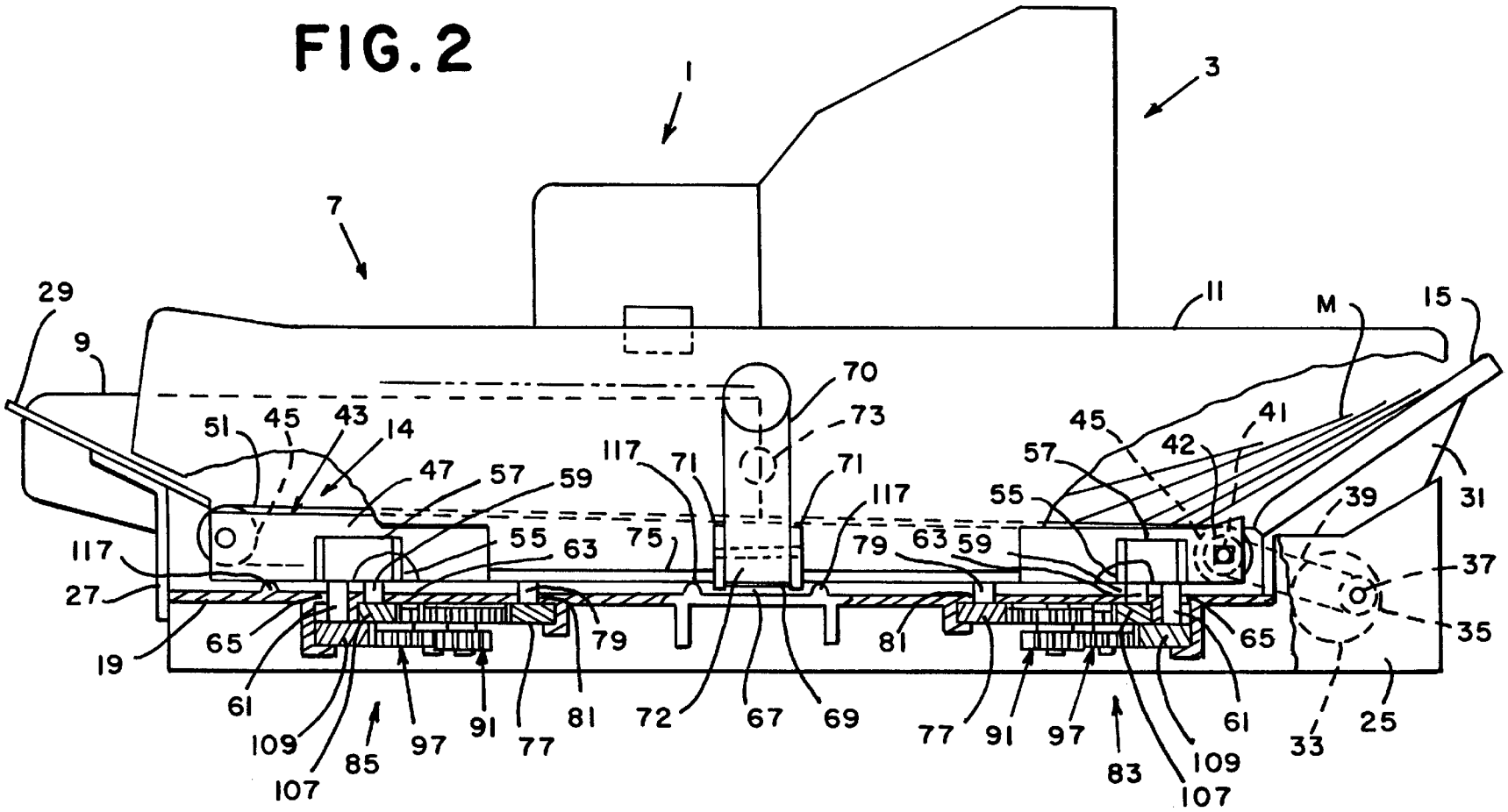
FIG. 2 is a right side elevational view of the apparatus of FIG. 1 shown partially in section and partially cut-away.
Figure 3:
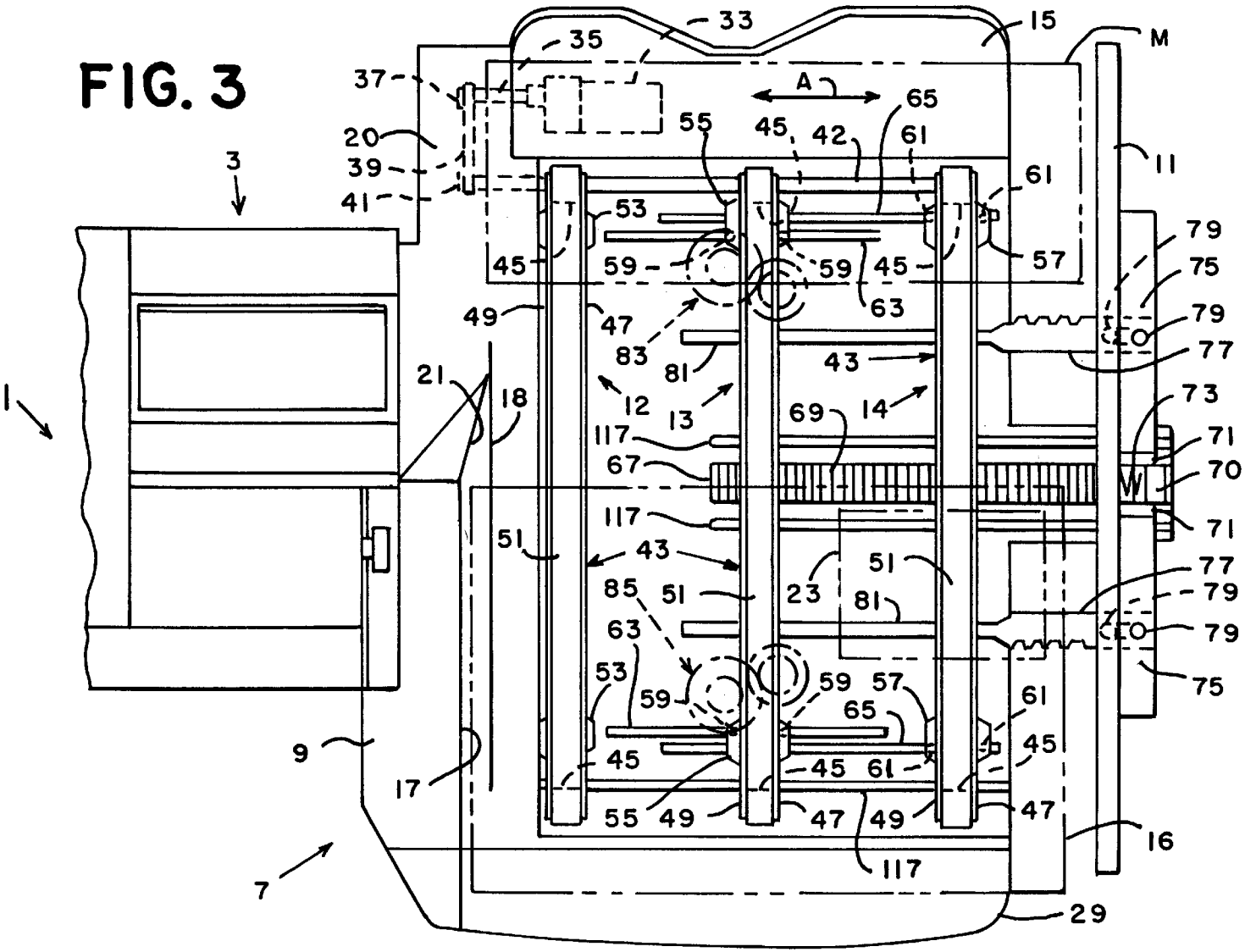
FIG. 3 is a top plan view of the apparatus of FIG. 1 in reduced scale.

Referring to FIGS. 1–3, a conventional mailing machine 1 delivers mailpieces in a sequential manner to a conventional postage meter 3 which imprints an indicia on the mailpieces. Mailing machine 1 includes a known driven mailpiece pullout structure 5 which ejects the imprinted mailpieces out of mailing machine 1. The inventive stacking machine 7 abuts against the mailing machine 1 and includes a ramped wall 9 against which the ejected mailpieces from the mailing machine 1 are received. The mailpieces ride up along ramp 9 and are projected along a path 10 into contact with a registration wall 11 while passing over conveyor belt assemblies 12, 13 and 14. The mailing machine 1 is typically capable of being set up to process batches of mailpieces of the same size. Moreover, the size of the mailpiece processed in any individual batch can range in size from, for example, 3 inch by 5 inch postcards to 9 inch by 12 inch flats. Because of the difference in the size of mailpieces being processed between batches, a problem exists in that if the stacking machine 1 has the registration wall 11 positioned to accommodate the large flats (as shown in FIG. 3), mailpieces smaller in size can possibly get caught and hung up on the belt assemblies 12, 13 and 14 or be improperly positioned along the belt assemblies 12, 13, and 14 such that they are not properly transported and stacked against an inclined stack wall 15 in the desired manner.

A large flat 16 (FIG. 3) is shown as having been ejected from mailing machine 1 such that it has hit registration wall 11 and dropped down on top of conveyor assemblies 12, 13 and 14. The position of registration wall 11 with respect to a rear wall 17 was originally set by aligning the trailing edge of the mailpiece 16 with a registration mark 18 on a deck 20 which is substantially even with a top surface of conveyor belts 51 and moving the registration wall 11 until it contacted the lead edge of the mailpiece 16. Since the distance between registration wall 11 and rear wall 17 was set for mailpieces having the length of mailpiece 16, when the mailpiece 16 hits the registration wall 11 it drops into a position between rear wall 17 and registration wall 11 such that all of the conveyor belt assemblies act on the mailpiece 16 to transport it onto the inclined stack wall 15. It is to be noted that rear wall 17 is positioned slightly away from registration mark 18 providing a tolerance to allow the mailpiece 16 to settle onto the conveyor belt assemblies 12, 13 and 14. However, as the mailpieces 16 are conveyed by conveyor belt assemblies 12, 13 and 14 toward stack wall 15 they contact an angled portion 21 of rear wall 17 which terminates at registration mark 18 to provide the final registration of the mailpiece 16 before moving up stack wall 15. Since the dimensioning between registration wall 11 and rear wall 17 provides little room for the mailpiece 16 to become skewed after it hits registration wall 11, it comes to rest on the conveyor assemblies 12, 13 and 14 in a position where it is substantially registered for conveyance onto stack wall 15. However, if registration wall 11 is not repositioned when a batch of small postcards 23 are ejected from mailing machine 1, they can bounce off of registration wall 11 and either 1) get caught on one of the conveyor belt assemblies 12, 13 and 14, 2) land in a severely skewered position, or 3) land such that they only contact one of the conveyor belt assemblies 14 as shown in FIG. 3. In order to overcome the problem associated with the processing of separate batches, of mail each of which consist of a different size mailpiece, registration wall 11 together with conveyor belt assemblies 13 and 14 are designed for movement together along the direction indicated by arrows "A" (as discussed in more detail herein below). This ensures that when registration wall 11 is adjusted for a particular size mailpiece of a particular batch, as discussed above in connection with registration mark 18, the conveyor belt assemblies 13 and 14 automatically are repositioned to ensure that the mailpieces being processed fall onto the conveyor belt assemblies 12, 13 and 14 in the same relative orientation as mailpiece 16 of FIG. 3.

Stacking machine 7 further includes a main frame 25 having a first stiffener 27 fixedly mounted thereto which supports a mailpiece support plate 29. Mailpiece support plate 29 is utilized to support large mailpieces which extend beyond the end of conveyor assemblies 12, 13 and 14. Moreover, stack wall 15 is supported by a flange structure 31 extending from frame 25 to provide adequate support as mailpieces "M" are stacked along their width in a shingled configuration on stack wall 15. Thus, it should now be readily apparent that the stacking machine 7 receives mailpieces from the mailing machine 1 and conveys and stacks them on stack wall 15 in a direction orthogonal to the feed path of mailing machine 1. As a result, when the operator faces the stack wall 15, the addressees and indicia of each mailpiece that falls onto the conveyor belt assemblies 12, 13 and 14 is clearly visible.

The conveyor assemblies 12, 13 and 14 are driven by a motor 33 which drives a shaft 35 and pulley 37 into rotation. A continuous belt 39 is disposed around pulley 37 at one end and around a pulley 41 at the other end. Pulley 41 is fixedly mounted on a square (or spline) shaft 42 such that as motor 33 is energized square shaft 42 is forced into rotation via drive train 35/37/39/41.

Each conveyor assembly 12, 13 and 14 includes a u-shaped channel structure 43 which extends across the stacking machine 7 as shown in FIGS. 2–3. Each channel structure 43 has a pulley 45 mounted in a conventional manner for rotation between channel walls 47, 49 at each end thereof. A respective continuous belt 51 is disposed around each of the pulleys 45 of conveyor belt assemblies 12, 13 and 14. The pulleys 45 at the end of conveyor belt assemblies 12, 13 and 14 which is closest to square shaft 42 are designed to have a matching inner surface to that of square shaft 42 such that they are mounted on and driven into rotation by the rotation of square shaft 42. Conveyor belt assembly 12 has a pair of boss structures 53 which are attached to walls 47,49 as well as being fixedly attached to deck 20 in a conventional manner such that conveyor belt assembly 12 is not free to slide along square shaft 42. In contrast, the other conveyor belt assemblies 13, 14 each have a respective pair of boss structures 55 and 57 extending therefrom which are not fixed to deck 19. Rather, boss structures 55 and 57 each have a pair respective of guide posts 59, 61 extending downward therefrom. The guide posts 59 extend through slots 63 in deck 19 so that conveyor belt assembly 13 is free to slide along square shaft 42 while maintaining its position orthogonal to the mailing machine 1 feed path. Guideposts 61 similarly pass through slots 65 so that conveyor belt assembly 14 is free to slide along square shaft 42. Thus, while the continuous belts 51 of conveyor assemblies 13 and 14 are driven into rotation by square shaft 42, they are freely slideable along square shaft 42 when not being driven into rotation.

The ability to adjust the position of registration wall 11 and conveyor belt assemblies 13 and 14 will now be discussed in connection with all of the Figures, but particularly with respect to FIGS. 2 and 4–5. Mounted on deck 19 is a track 67 having a plurality of individual teeth 69. Registration wall 11 has a handle 70 pivotally mounted to a pair of flanges 71 extending from registration wall 11. Handle 70 includes a bottom portion 72 which is normally biased into engagement with one of the teeth 69 by a spring 73 to fix the registration wall 11 in place. However, when it is desired to move registration wall 11 in the direction of arrow "A", handle 70 is pressed against the biasing force of spring 73 disengaging end 72 from teeth 69 such that registration wall 11 is free to slide along deck 19. When registration wall 11 is repositioned at its desired new location, it is released allowing spring 73 to bias end 72 back into engagement with a different one of teeth 69 thereby fixing registration wall 11 in its new position. A lower end portion 75 of registration wall 11 has a pair of rack gears 77 fixedly connected thereto in a conventional manner via a pair of guide posts 79. As registration wall 11 is moved toward mailing machine 1, guide posts 79 slide in corresponding slots 81 in deck 19.

A pair of gear trains 83,85 each interact with a corresponding one of the rack gears 77 in order to effectuate automatic movement of conveyor belt assemblies 13 and 14 together with registration wall 11. FIGS. 4 and 5 show an enlarged and spread out detailed view of gear train 85 and will be utilized to describe the operation thereof as well as the operation of gear train 83 which functions in an identical manner. Referring specifically to FIGS. 2 and 4–5, as registration wall 11 is manually moved toward mailing machine 1, rack gears 77 move therewith. Teeth 87 of rack gear 77 engage first teeth 89 of a first gear set 91 which is mounted in a conventional manner to deck 19 to be freely rotatable. Gear set 91 is thus driven into a counterclockwise rotation such that second gear teeth 93 of gear set 91 engage first gear teeth 95 of a second gear set 97 which is mounted for rotational movement to deck 19. Gear set 97 is thus forced to rotate in the clockwise direction such that its first and second gear teeth 95 and 99 respectively engage gear teeth 103 and 105 of respective rack gears 107 and 109. Rack gear 107 is fixedly connected to guideposts 59 of conveyor belt assembly 13 while rack gear 109 is fixedly connected to guide posts 61 of conveyor belt assembly 14. Accordingly, as second gear set 97 rotates in the clockwise direction, rack gears 107 and 109 are forced to move in a linear direction toward mailing machine 1 respectively carrying conveyor belt assemblies 13, 14 therewith. Since the gear train 83 functions in the same manner as gear train 85, the full extent of conveyor belt assemblies 13 and 14 are moved along the linear path defined by the arrows "A". Naturally, if registration wall 11 is moved away from mailing machine 1 all of the above mentioned gears move in the opposite direction causing the conveyor belt assemblies 13 and 14 to move away from mailing machine 1.

Figure 4:
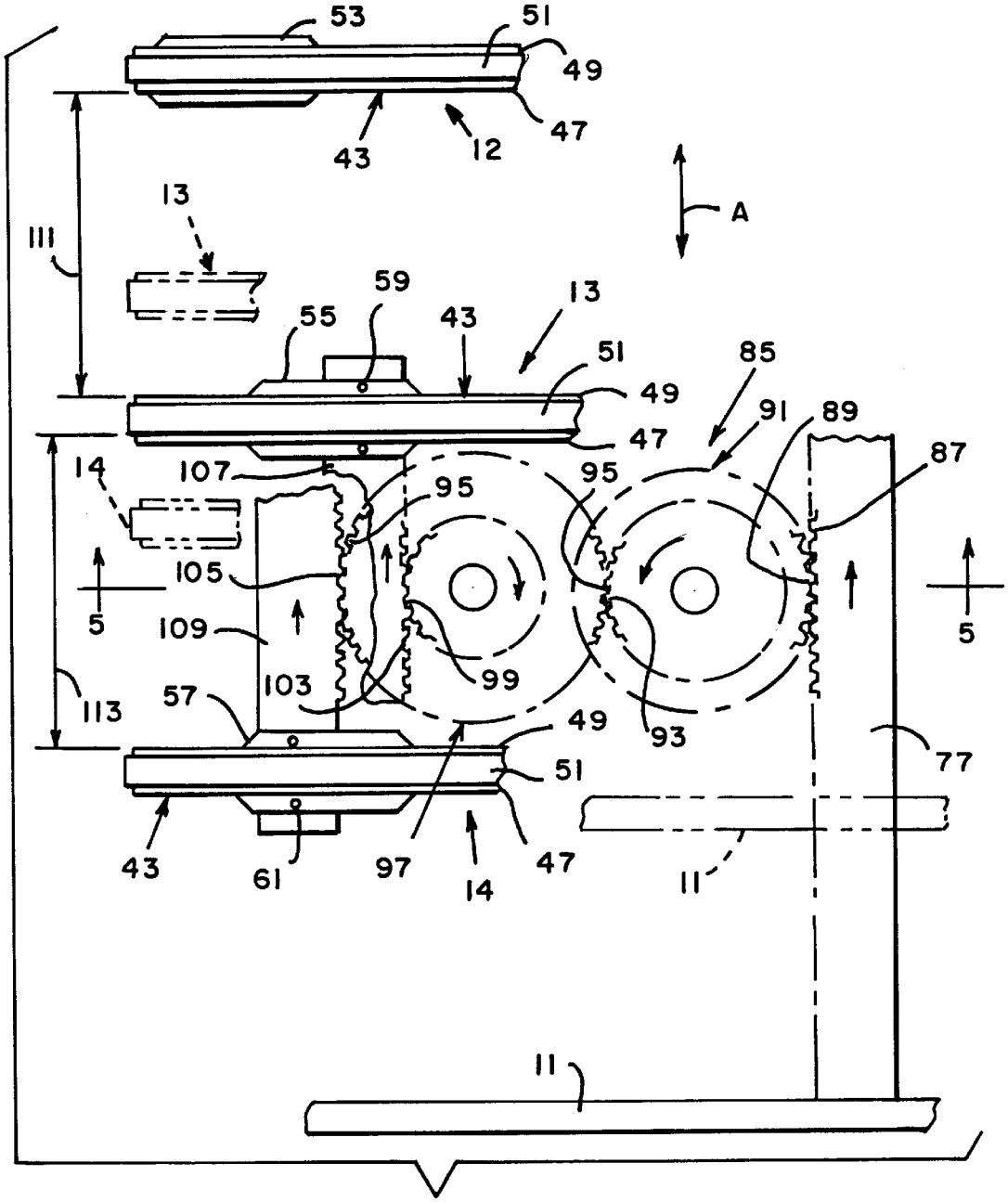
FIG. 4 is a stretched out and enlarged view of the inventive gear train.
Figure 5:
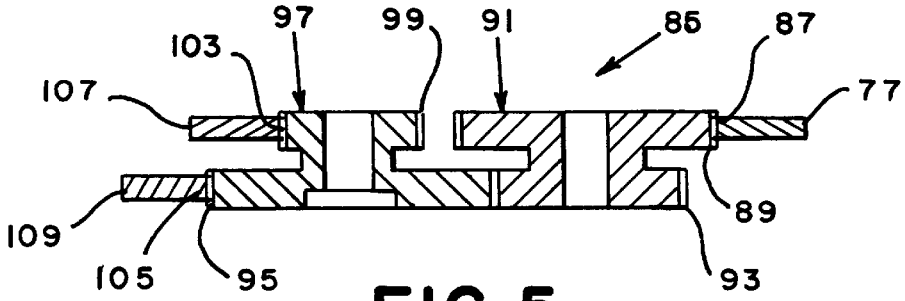
FIG. 5 is a cross-sectional view of the gear train of FIG. 4 taken along line 5—5.

Referring to FIGS. 4 and 5, another important aspect of the inventive apparatus is shown with respect to the movement of registration wall 11 and conveyor belt assemblies 13 and 14 from their positions shown in solid lines to their positions shown in dashed lines. That is, in order to ensure that when the registration wall 11 is moved to accommodate different size mailpieces the conveyor belt assemblies 13 and 14 are properly repositioned automatically to prevent skewing or improper stacking of mailpieces from occurring, it is important that the distance 111 between conveyor belt assemblies 12 and 13 and the distance 113 between conveyor belt assemblies 13 and 14 remain substantially equal to each other. That is, when the registration wall 11 is moved toward mailing machine 1 both of the distances 111 and 113 become smaller and when registration wall 11 is moved away from mailing machine 1 both distances 111 and 113 become larger. However, with respect to each other, the distances 111 and 113 remain approximately the same. This ensures that the specific mailpiece, which registration wall 11 has been adjusted to accommodate, will fall onto the conveyor belt assemblies 12, 13 and 14 such that a substantially even feed force will be applied by all of the conveyor belts assemblies 12, 13 and 14 over the width of the mailpiece and the fallen mailpiece will not be substantially skewed or caught on one of the conveyor belts 51.

The automatic repositioning of the conveyor belt assemblies in response to movement of registration wall 11 is accomplished because the total number of teeth 95 is twice as much as the total number of teeth 99. Thus, since both sets of teeth are part of gear set 97 and are rotated together, rack gear 109 will move in a linear direction twice as far as the corresponding linear movement of rack gear 107. Since conveyor belt assembly 12 is fixed in place, this ensures that the distances 111 and 113 always remain equal despite the fact that these distances are constantly changing as registration wall 11 is moved toward and away from mailing machine 1. For example, in the solid line position conveyor belt assembly 12 is spaced 2.5 inches from conveyor belt assembly 13 while conveyor belt assembly 14 is spaced 2.5 inches from conveyor belt assembly 13. As registration wall 11 moves to its dashed line position, it causes conveyor belt assemblies 13 and 14 to move to their dashed line positions such that the distances 111 and 113 have been reduced but remain equal to each other at 1.5 inches. Thus, when the smaller mailpiece, for which registration wall 11 has been repositioned falls onto the conveyor belt assemblies 12, 13 and 14, the conveyor belt assemblies 12, 13 and 14 will be positioned substantially evenly across the width of the mailpiece.

In operation, as mailpieces are ejected from mailing machine 1, they pass by a conventional through-beam sensor 115. Sensor 115 detects the presence of each mailpiece and sends a signal indicative thereof to a microprocessor (not shown) associated with the stacking machine 7. The microprocessor upon receipt of the signal energizes motor 33 for a predetermined period of time to move the conveyor belts a predetermined distance. Thus, when subsequent mailpieces are ejected from mailing machine 1 they land on the conveyor assemblies 12, 13, and 14 in a shingled orientation relative to previously received mailpieces and are transported to stack wall 15 in that manner. Moreover, during movement of registration wall 11, channel structures 43 and registration wall 11 each slide along ribs 117 which extend from deck 19.

Additional advantages and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims. For example, while the preferred embodiment describes an external smart card, it could also be a card with a magnetic stripe or any equivalent type of structure.

What is claimed is:

1. An apparatus for stacking mailpieces received from a mail processing machine, the apparatus comprising:

a deck;

a sloped wall extending from the deck;

a plurality of continuous belts each extending along the deck in a first direction and positioned at substantially equal intervals along a second direction of the deck, each of the plurality of continuous belts having a top surface which extends above the deck and which contacts the mailpieces received from the mail processing machine;

means for driving the plurality of belts in the first direction to move the received mailpieces along the sloped wall in a shingled configuration; a registration wall disposed on the deck to define a landing area on the deck for the received mailpieces, the registration wall being mounted for slideable movement along the deck in the second direction to change a size of the landing area to accommodate the receiving of different sized mailpieces from the mail processing machine; and means, connected to the registration wall and the plurality of continuous belts, for automatically moving at least some of the plurality of continuous belts along the second direction in response to movement of the registration wall along the second direction, wherein at times when the registration wall is moved along the second direction the intervals at which the plurality of continuous belts are positioned along the second direction change in size but remain substantially equal to each other.

2. An apparatus as recited in claim 1, wherein the plurality of continuous belts includes first, second, and third continuous belts, the first continuous belt is fixed in position along the second direction, the moving means includes a first rack gear mounted to the registration wall to be moveable therewith along the second direction, a second rack gear connected to the second continuous belt, a third rack gear connected to the third continuous belt, and a gear train which engages the first, second and third rack gears such that at times when the first rack gear moves along the second direction the second and third rack gears are forced via the gear train to move along the second direction respectively carrying the second and third continuous belts therewith.

3. An apparatus as recited in claim 2, wherein the gear train includes a first gear set and a second gear set each mounted to the deck for rotation, the first gear set engages the first rack gear and the second gear set, the second gear set includes first and second gear teeth which are respectively in engagement with the second and third rack gears, and at times when the first rack gear moves along the second direction a fixed distance, it forces the first gear set into rotation, which forces the second gear set into rotation whereby the second rack gear moves in the second direction and the third rack gear moves approximately twice as far along the second direction as compared to the second rack gear.

4. An apparatus as recited in claim 3, wherein the drive means includes a motor, a common drive shaft connected to the motor and each of the first, second and third continuous belts such that the motor drives each of the first second and third continuous belts, and means for connecting the second and third continuous belts to the common drive shaft such that at times when the second and third belts are not being driven by the motor they are slideable along the common drive shaft in the second direction.

5. An apparatus as recited in claim 4, wherein the common drive shaft is one of a square shaft and a spline shaft.

6. An apparatus as recited in claim 5, wherein the deck further includes a registration mark thereon such that a distance between the registration mark and the registration wall identifies the width of the mailpieces to be stacked.

7. An apparatus as recited in claim 6, wherein the second direction is the same as a direction from which the mailpieces are received from the mailing machine and the first direction is substantially perpendicular thereto.

* * * * *